US006657640B2

(12) United States Patent
Shigeta

(10) Patent No.: US 6,657,640 B2
(45) **Date of Patent: *Dec. 2, 2003**

(54) IMAGE DISPLAY APPARATUS

(75) Inventor: Kazuyuki Shigeta, Atsugi (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/185,568

(22) Filed: Nov. 4, 1998

(65) Prior Publication Data

US 2002/0075209 A1 Jun. 20, 2002

(30) Foreign Application Priority Data

Nov. 6, 1997 (JP) ..... 9-304582

(51) Int. Cl.[7] ..... G09G 5/10
(52) U.S. Cl. ..... 345/690; 345/698; 345/806; 345/98

(58) Field of Search ..... 345/87, 88, 89, 345/98, 100, 204, 205, 206, 519, 520, 521, 507, 186, 698, 690, 806, 803, 781, 536, 548; 348/375, 376, 232, 233, 333.05, 231.7, 231.8; 382/209

(56) References Cited

U.S. PATENT DOCUMENTS

| | | | | | |
|---|---|---|---|---|---|
| 5,200,863 | A | * | 4/1993 | Orii | 360/35.1 |
| 5,557,691 | A | * | 9/1996 | Izuta | 382/209 |
| 5,724,155 | A | * | 3/1998 | Saito | 358/402 |
| 5,790,193 | A | * | 8/1998 | Ohmori | 348/375 |
| 6,145,046 | A | * | 11/2000 | Jones | 710/129 |
| 6,147,708 | A | * | 11/2000 | Suzuki et al. | 348/232 |

* cited by examiner

*Primary Examiner*—Xiao Wu
(74) *Attorney, Agent, or Firm*—Fitzpatrick, Cella, Harper & Scinto

(57) ABSTRACT

In an image display apparatus having an image processing unit for processing a digital signal, a data memory unit for storing data corresponding to at least one frame of an image, and an image display unit for displaying the image on the basis of an image signal from the image processing unit, the data memory unit can be dismounted, or at least part of the data memory unit can be added/removed.

27 Claims, 11 Drawing Sheets

IMAGE DISPLAY APPARATUS

BACKGROUND OF THE INVENTION

1. Field of the Invention

The present invention relates to an image display apparatus.

2. Related Background Art

In recent years, as the image information amount of a personal computer increases, the display monitor has a higher resolution and a larger number of gradation levels, and processes various composite information such as TV information. With the advent of monitors such as a liquid crystal display and a plasma display other than a CRT, image information is often digitized and processed.

FIG. 13 is a block diagram showing an image display apparatus using a liquid crystal panel as an image display unit.

Referring to FIG. 13, the image display apparatus comprises an input terminal 1 for an analog video signal, an A/D converter 2, an image processing unit 3 for processing a digital image and converting it to a signal suitable for the liquid crystal panel, a D/A converter 4, an image memory 5 used to process an image by the image processing unit 3, an input terminal 6 for a video signal synchronizing signal, and a drive pulse generator 7 for generating various drive and control pulses from the synchronizing signal. Pulses from the drive pulse generator 7 serve as control pulses for the A/D converter 2, D/A converter 4, and image processing unit 3, and a drive pulse for an image display unit 8. The analog signal converted by the D/A converter 4 serves as an image input signal for the image display unit 8.

FIG. 14 is a circuit diagram showing the arrangement of the liquid crystal panel as an example of the image display unit 8. Referring to FIG. 14, a shift register (HSR) 9 functions as a horizontal scanning circuit and receives a start pulse (ϕHST) 10 and a horizontal shift clock (ϕHCK) 11. A shift register (VSR) 12 functions as a vertical scanning circuit and receives a start pulse (ϕVST) 13 and a vertical shift clock (ϕVCK) 14. The liquid crystal panel further comprises a video signal input terminal 15, a common signal line 36, a vertical signal line 17, transfer switches 16 and 19 made up of MOS transistors, a gate line 18, a liquid crystal cell 20, a capacitor 21 for holding the charge, and a liquid crystal counter electrode (common electrode) 22.

Input video signals are sequentially selected by the horizontal shift register (HSR) 9 and transferred to the vertical signal lines 17 via the transfer switches 16. At this time, the vertical shift register (VSR) 12 selects a given gate line 18. Accordingly, a transfer switch 19 of a specific pixel selected as a matrix by the horizontal shift register (HSR) 9 and the vertical shift register (VSR) 12 is selected. The liquid crystal cell 20 and capacitor 21 are charged with the potential of the video signal of the specific pixel with respect to the potential of the counter electrode 22, thereby performing pixel display.

Along with the development of recent device technology, the number of pixels and the number of gradation levels in image display devices such as the liquid crystal panel greatly increase, and the data amount processed in the image display apparatus also increases. For example, the data amount is 5.5 Mbits/frame in VGA class (640×480 pixels and three R, G, B colors of 6-bit precision), 18.9 Mbits/frame in XGA class (1,024×768×8 bits×three colors), and 31.5 Mbits/frame in SXGA class (1,280×1,024×8 bits×three colors). As the resolution and the number of gradation levels increase, the cost of the memory occupies a large proportion of the total cost.

However, the frame memory of a conventional image display apparatus, which has an amount necessary for the resolution of the image display unit, is mounted on the same board as the image processing unit. When an upgraded product having a larger number of display pixels is to be manufactured, a board 26 (dotted region in FIG. 13) for mounting a memory in size corresponding to the resolution of a new image display unit must be redesigned. The design load and uncommon components increase the cost.

Also, the board cannot be commonly used between a single-function product having only a frame memory, and an advanced-function product having a picture-in-picture function, a frame dividing function, and the like using many memories.

SUMMARY OF THE INVENTION

It is an object of the present invention to realize the lineup of a plurality of grades of products at a low cost by sharing the region except for the memory which occupies a large proportion of the total cost and by attaining a memory expandable arrangement in increasing the resolution and the number of functions in the display.

To achieve the above object, according to the present invention, there is provided an image display apparatus having image processing means for processing a digital signal, data memory means for storing data corresponding to at least one frame of an image, and image display means for displaying the image on the basis of an image signal from the image processing means, wherein the data memory means can be dismounted.

According to the present invention, there is provided an image display apparatus having image processing means for processing a digital signal, data memory means for storing data corresponding to at least one frame of an image, and image display means based on an image signal from the image processing means, wherein at least part of the data memory means can be added/removed.

According to the present invention, a non-data-memory means such as the image processing unit other than the data memory means can be shared by a plurality of products having different resolutions, different numbers of gradation levels, or different functions in the image display means. The development cost of the product can be reduced to easily realize cost reduction. The memory is divided in correspondence with divisional driving unique to the image display means, and part of the memory is dismounted or added/removed to simplify the system arrangement.

The present invention is applicable to any image display apparatus involving digital image processing such as a transmission or reflecting display, liquid crystal display, or display using FED (Field Emission Device) or SCE (Surface Conductive Emission Device), or PDP (Plasma Display Panel).

DETAILED DESCRIPTION OF THE PREFERRED EMBODIMENTS

Embodiments of the present invention will be described in detail below with reference to the accompanying drawings.

First Embodiment

Figure 1:
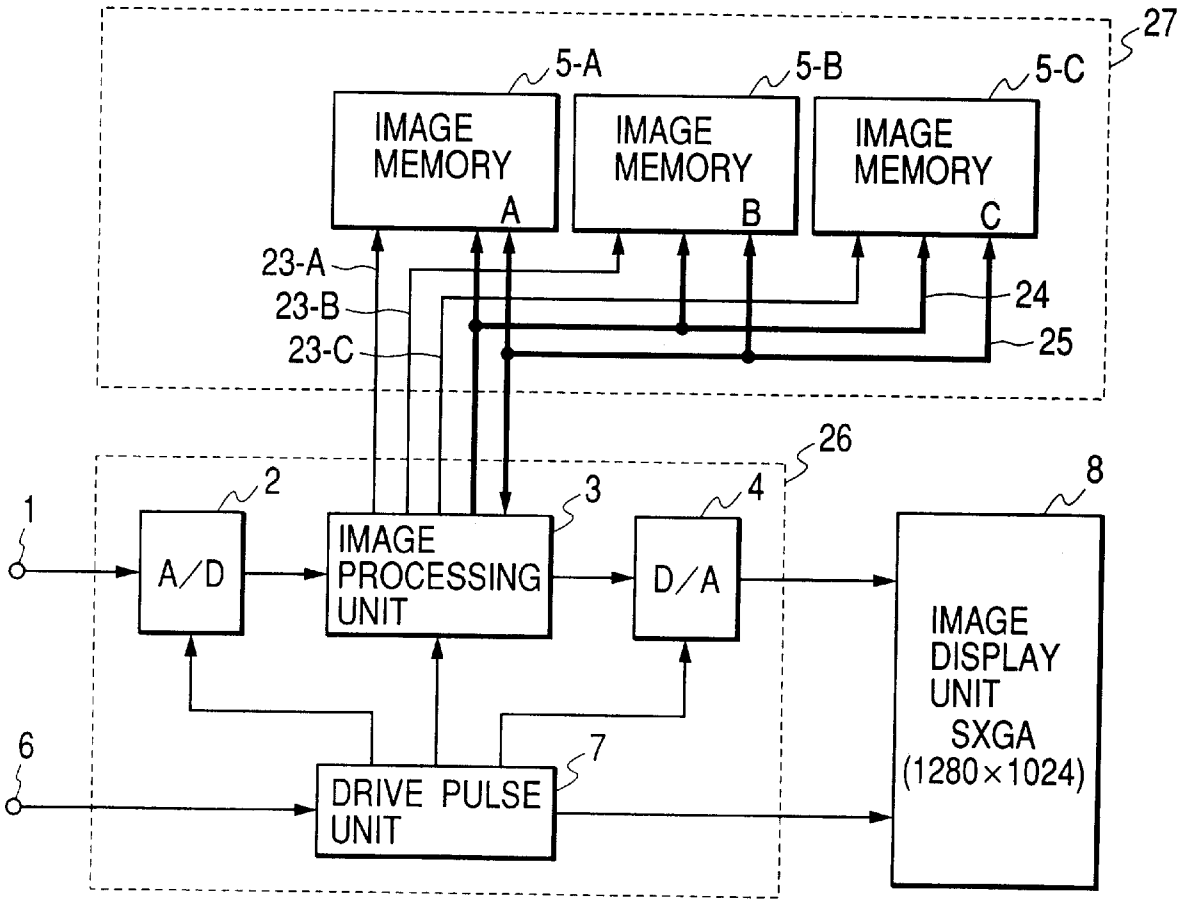
FIG. 1 is a block diagram showing an image display apparatus for explaining the first embodiment of the present invention.
Figure 2:
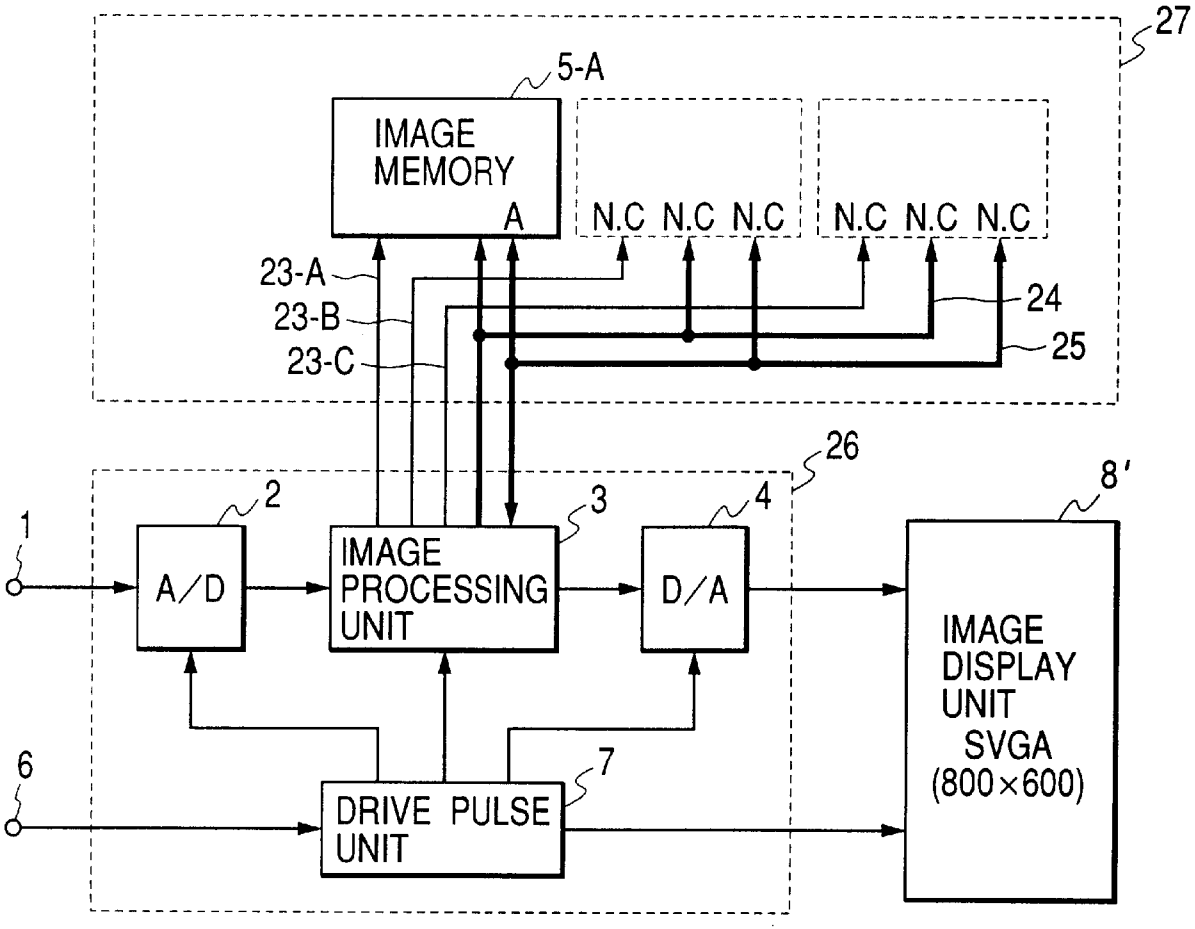
FIG. 2 is a block diagram showing the image display apparatus for explaining the first embodiment of the present invention.

FIGS. 1 and 2 are block diagrams showing an image display apparatus according to the first embodiment of the present invention. Referring to FIGS. 1 and 2, the image display apparatus comprises an input terminal 1 for an analog video signal, an A/D converter 2, an image processing unit 3 for processing a digital image and converting it to a signal suitable for an image display unit, a D/A converter 4, image memories 5-A, 5-B, and 5-C used to process an image by the image processing unit 3, an input terminal 6 for a video signal synchronizing signal, a drive pulse generator 7, controls lines 23-A, 23-B, and 23-C corresponding to the image memories 5-A, 5-B, and 5-C, an address bus 24, and a data bus 25. The image processing unit 3 and drive pulse generator 7 constitute an image processing means. The A/D converter 2, the image processing unit 3, the D/A converter 4, and the drive pulse generator 7 are mounted on the same board 26, whereas the memory unit is mounted on another board 27. The image processing unit 3 outputs predetermined memory control signals 23-A, 23-B, and 23-C.

A system for image display units 8' and 8 having different resolutions, e.g., SVGA resolution (800×600 pixels) and SXGA resolution (1,280×1,024 pixels) will be described.

Figure 3:
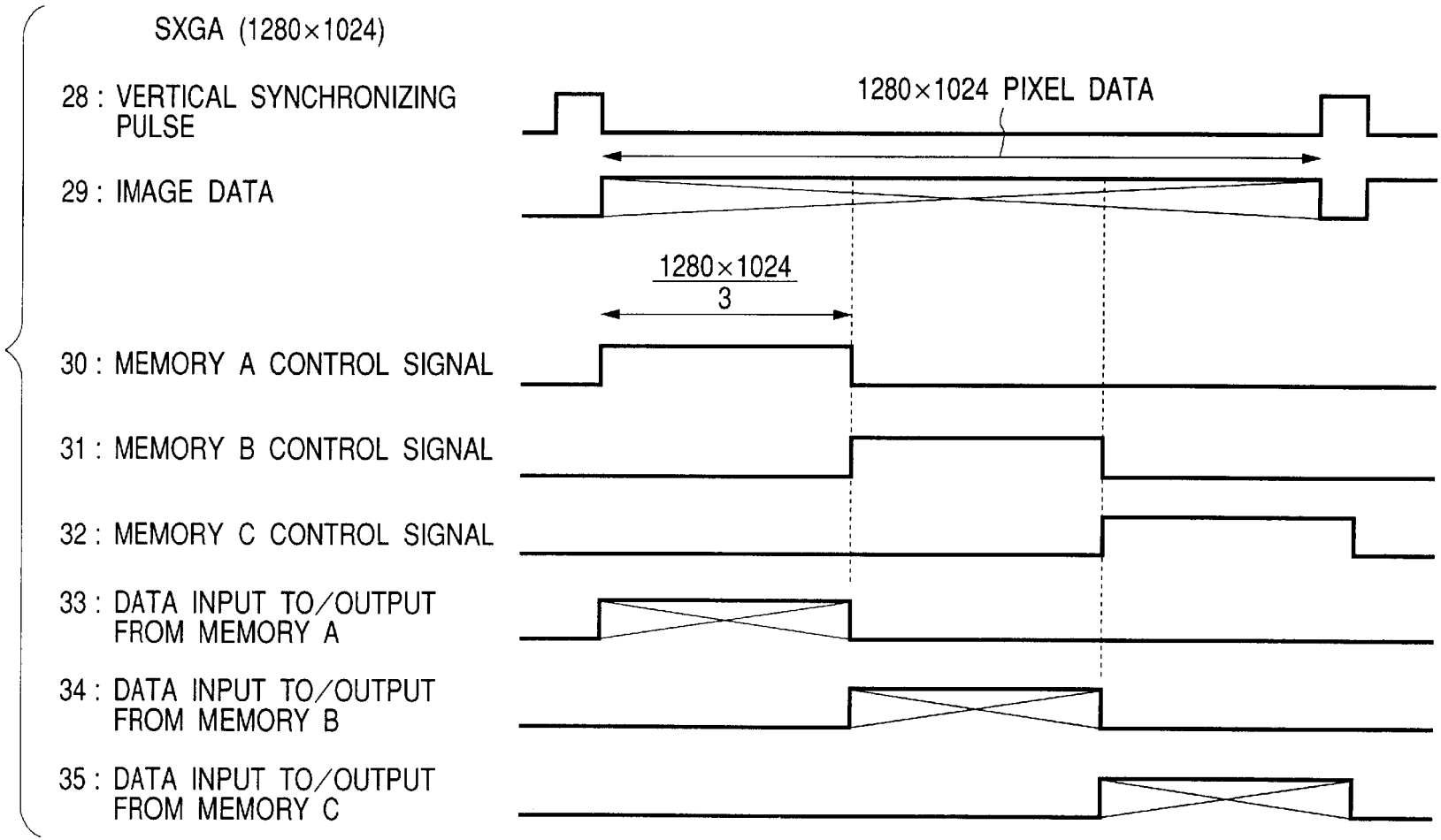
FIG. 3 is a timing chart showing operation of the image display apparatus for explaining the first embodiment of the present invention.
Figure 4:
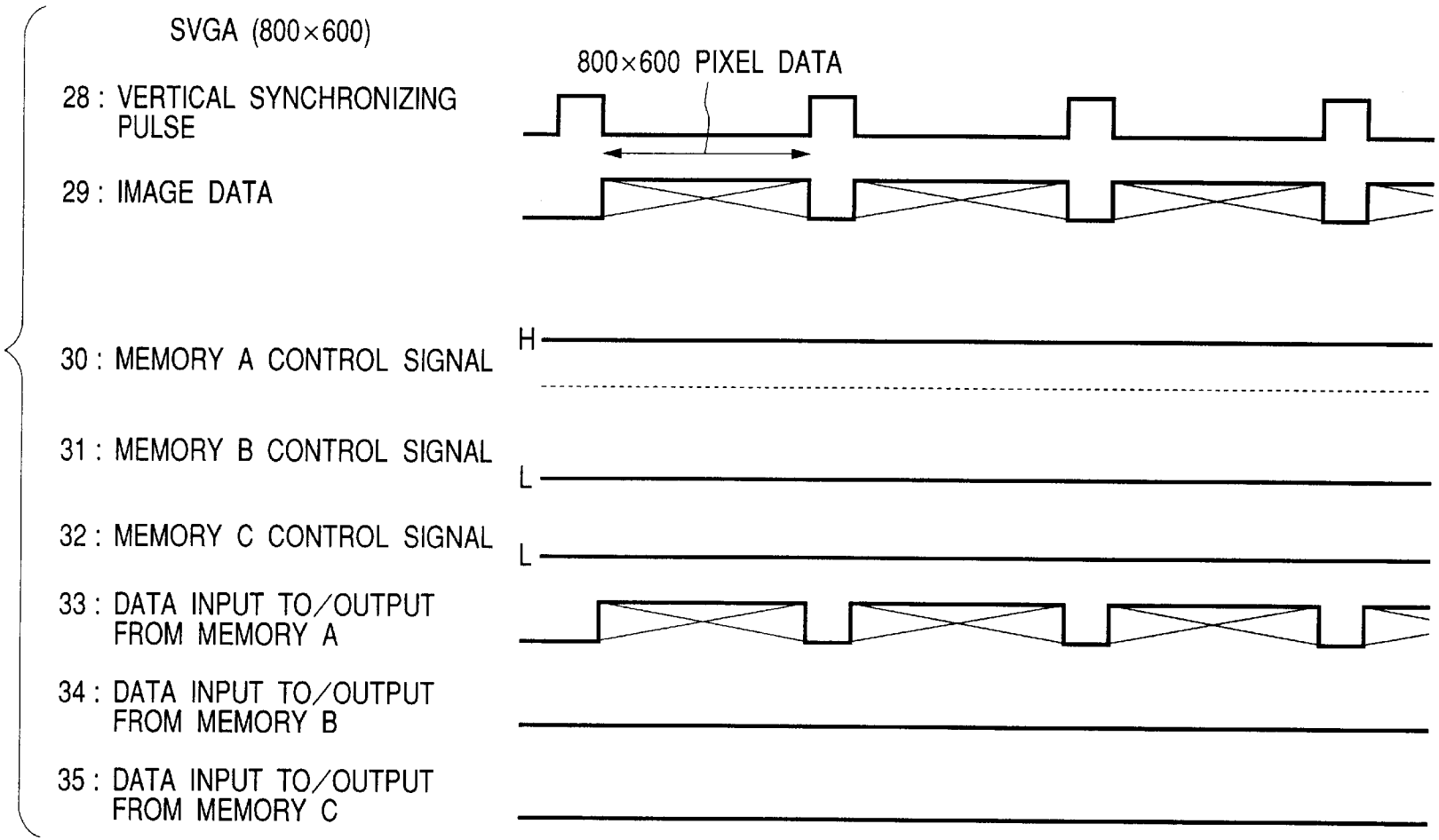
FIG. 4 is a timing chart showing operation of the image display apparatus for explaining the first embodiment of the present invention.

SXGA has the number of pixels about three times larger than that of SVGA. Although SXGA is constructed as shown in FIG. 1, as to SVGA, as shown in FIG. 2, the memory on the memory unit board is decreased in size to ⅓ the memory in FIG. 1, and the control line, data line, and address line of an idle memory are not connected. FIGS. 3 and 4 are timing charts showing signals in this case.

Image data 29 is exchanged between the image processing unit and the memory in response to a vertical synchronizing signal 28. In SXGA, controls signals 30, 31, and 32 for memories A, B, and C are sequentially supplied to switch data 33, 34, and 35 input/output to/from the respective memories (FIG. 3). In SVGA, since the necessary memory amount is ⅓, only the memory A control signal is supplied (H level) as shown in FIG. 4, no memory B/C control signal is supplied (L level), and only memory A is mounted on the board.

Even if the number of pixels of the image display unit changes, the arrangement can correspond to a high-resolution product at a low cost by preparing a plurality of control modes for the image processing unit in advance, preparing a control signal for a memory to be added, and sharing the region (board 26) except for the image memory board. A plurality of control modes for the image processing unit may not be prepared in advance because such an image processing unit is often customized with a gate array and the like. The image processing unit is formed with a pin arrangement in which a plurality of control lines are prepared in advance, and only the gate array is reformed on the same pin arrangement in accordance with an SVGA or SXGA product. In this case, the same merits as in the common board can be obtained.

Second Embodiment

For an increase in resolution of the display, the drivable speed of the display device such as a liquid crystal display determines a feasible resolution. As a method of eliminating this limitation, divisional driving of simultaneously writing signals in a plurality of pixels is known.

Figure 5:
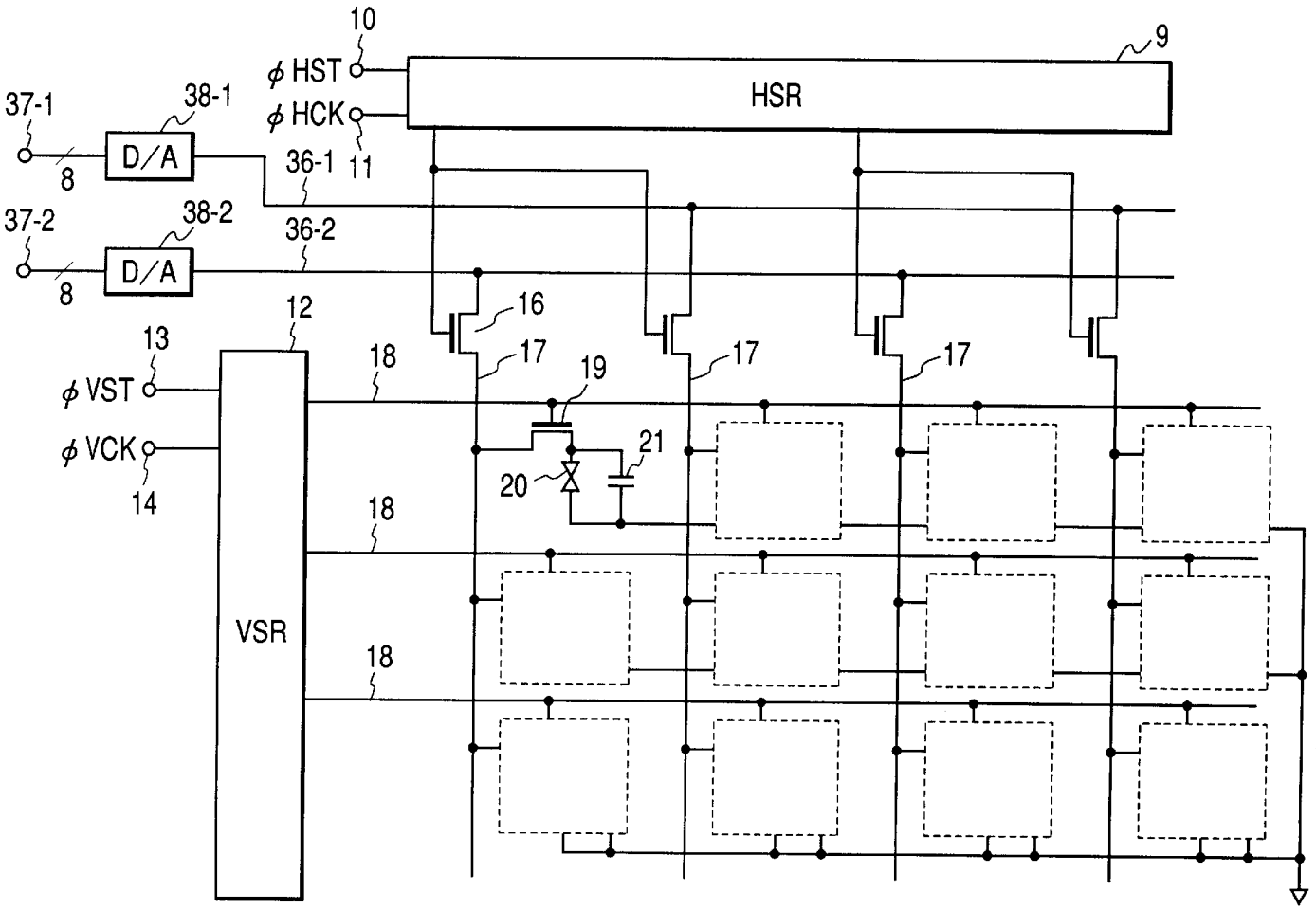
FIG. 5 is a circuit diagram showing the arrangement of a liquid crystal panel used in the second embodiment of the present invention.

FIG. 5 exemplifies a liquid crystal panel which performs 2-divisional driving of simultaneously writing signals in two pixels. Components 9 to 21 in the second embodiment are the same as those of the liquid crystal panel shown in FIG. 14. In the second embodiment, a digital input liquid crystal panel receives an 8-bit digital signal and incorporates a D/A conversion function.

Figure 14:
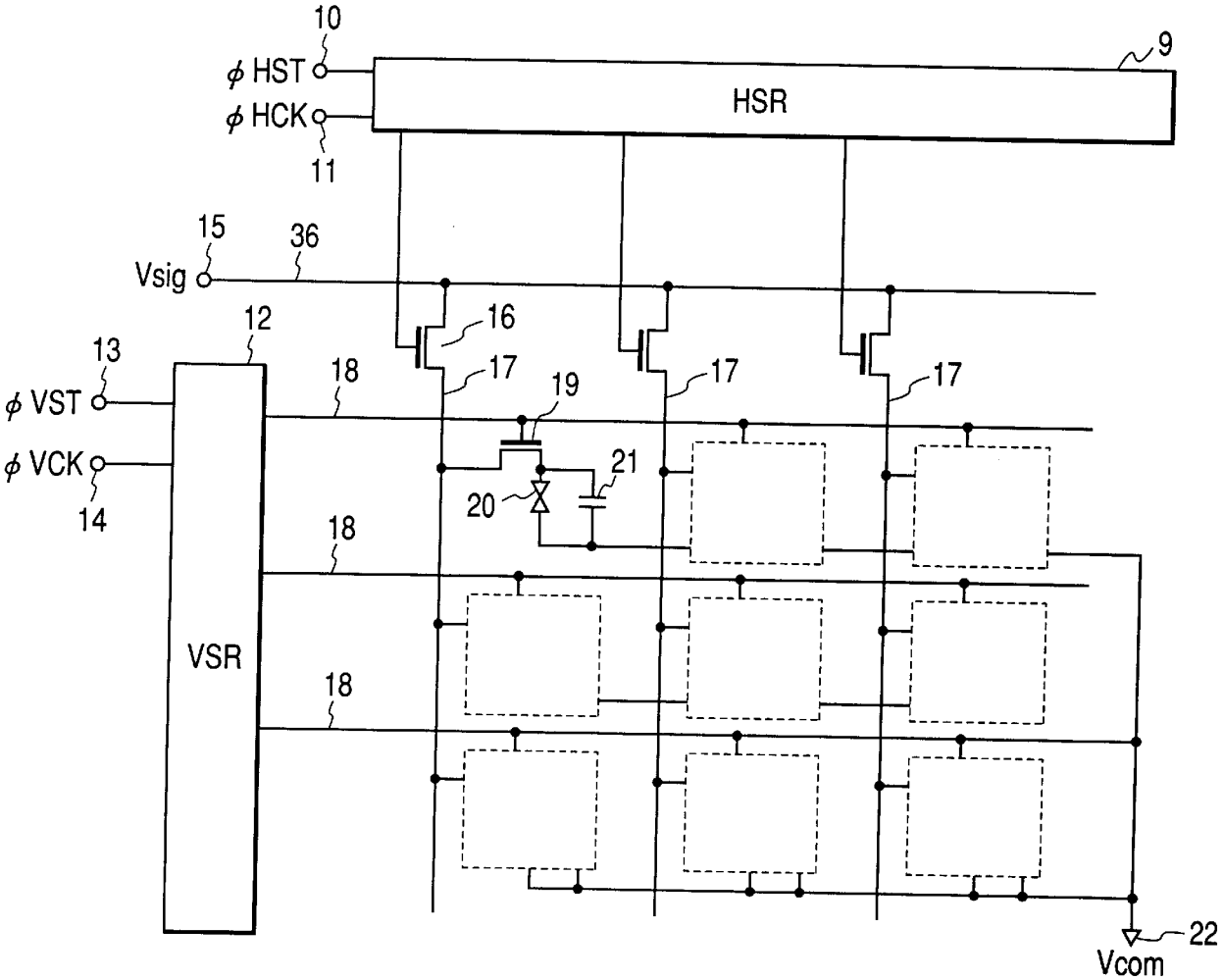
FIG. 14 is a circuit diagram showing a liquid crystal panel.

The liquid crystal panel in FIG. 5 is different from the panel in FIG. 14 in that the input signal is digital, the input terminal is made up of two systems 37-1 and 37-2, signals are simultaneously supplied to common signal lines 36-1 and 36-2 via D/A converters 38-1 and 38-2, and an output from the horizontal shift register also simultaneously switches switches 16 connected to two adjacent vertical signal lines 17. As a result, signals can be written in pixels twice while the speed of the horizontal shift register is the same as the conventional one.

This means that when writing signals in a liquid crystal panel having an XGA resolution of 1,024×768 pixels requires a speed of 70 Mhz, signals can be written in SXGA having 1,280×1,024 pixels about twice the number of XGA pixels not at 140 MHz but at the same speed as in XGA, i.e., 70 MHz×2 systems.

Figure 6:
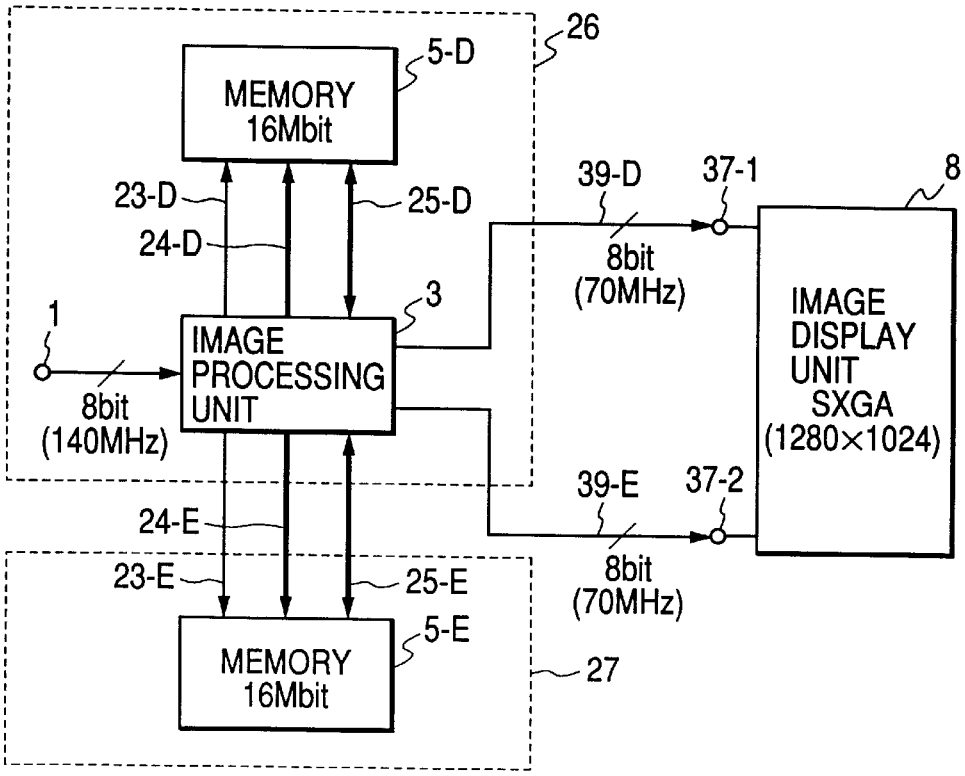
FIG. 6 is a block diagram showing an image display apparatus for explaining the second embodiment of the present invention.
Figure 7:
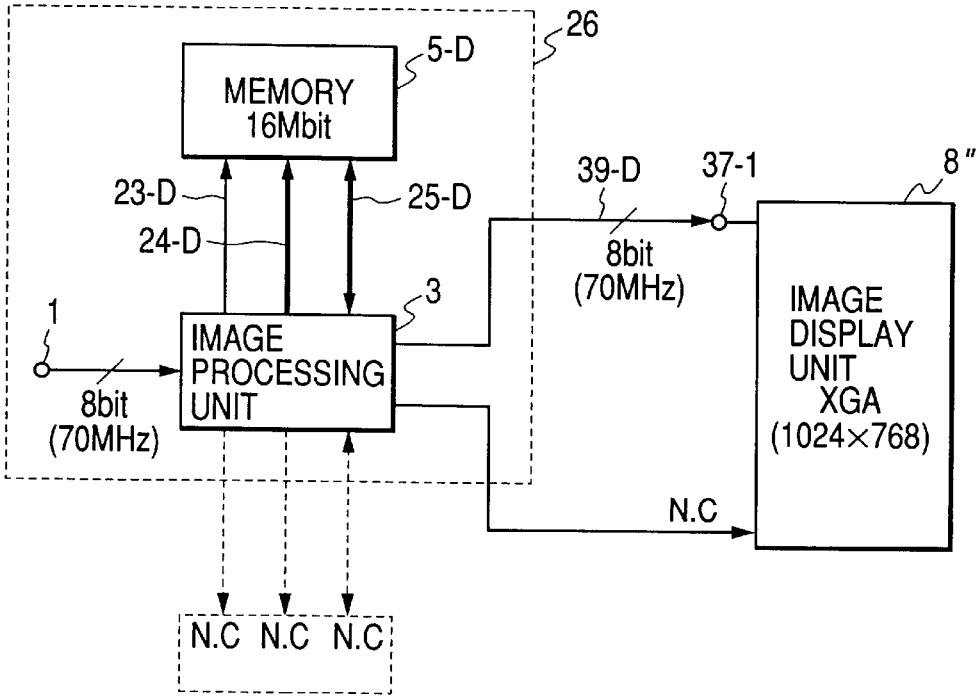
FIG. 7 is a block diagram showing the image display apparatus for explaining the second embodiment of the present invention.

FIGS. 6 and 7 are block diagrams showing the second embodiment of the present invention.

Figure 8:
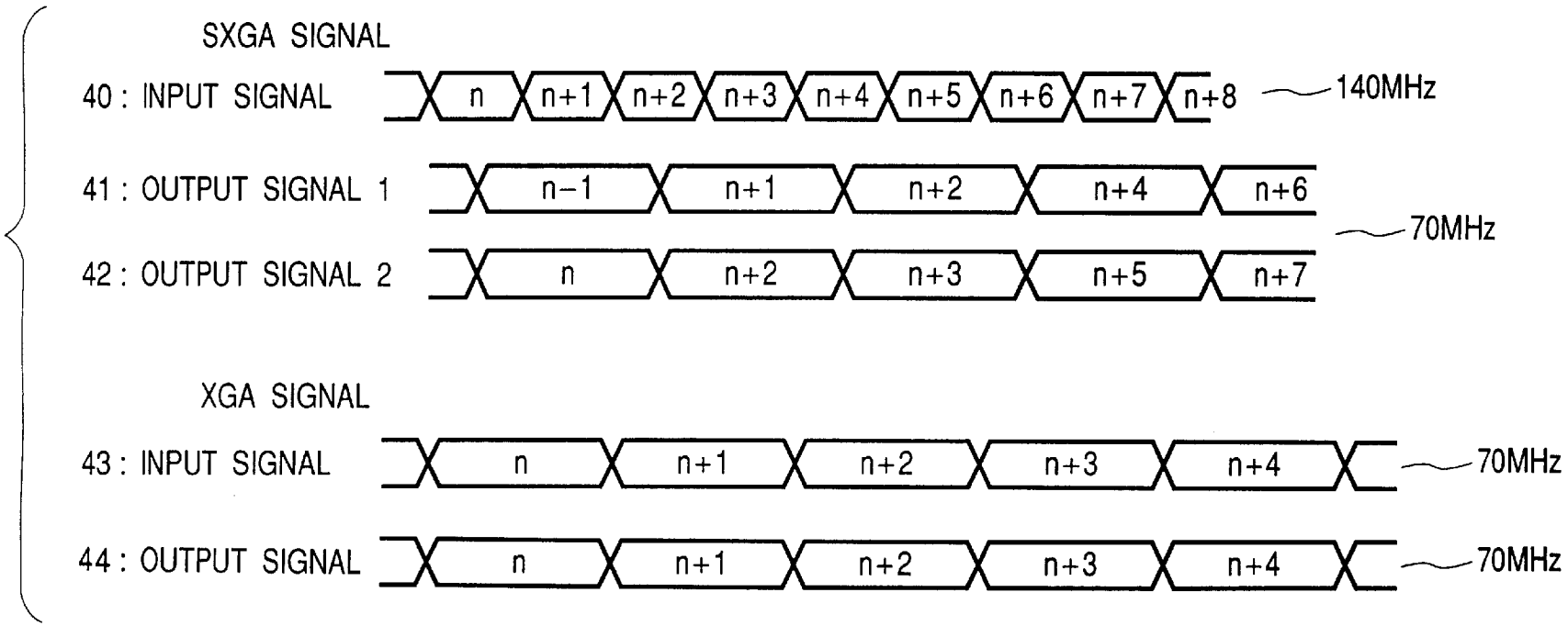
FIG. 8 is a timing chart for explaining the second embodiment of the present invention.

An input signal of about 140 MHz in FIG. 6 (SXGA) or an input signal of about 70 MHz in FIG. 7 (XGA) is input to an image processing unit 3 via an input terminal 1 for an 8-bit digital video signal. In FIG. 6, a digital input signal 40 in FIG. 8 is demultiplexed to signals 41 and 42 at half the speed and the same timing in the image processing unit. One signal is image-processed via a memory 5-D and input to one terminal 37-1 of the two systems of the liquid crystal panel via an output 39-D.

The other signal is image-processed via a memory 5-E and input to the other input terminal 37-2 of the two systems of the liquid crystal panel via an output 39-E. An SXGA image is displayed at about 70 MHz. The driving pulse unit is not illustrated in the second embodiment (also in the following embodiments). The memory 5-D and image processing unit 3 are mounted on a board 26, whereas the memory 5-E is mounted on a board 27.

For an XGA image display unit 8", the board 27 of the memory 5-E is dismounted. An input signal 43 of about 70 MHz shown in FIG. 8 is input to the image processing unit, processed via only the memory 5-D, input via an output 39-D to the XGA liquid crystal panel which does not perform divisional driving, and displayed at about 70 MHz (FIG. 7). In FIG. 8 numeral 44 denotes an output signal.

Since no memory 5-E is required, a control line 23-E and an address line 24-E are set at high impedance, and a data line 25-E serving as an input/output terminal is also set at high impedance in the output direction. At this time, circuit operation on the memory 5-E side is stopped to reduce the power consumption. This switching circuit is incorporated in the image processing unit 3 to allow addition/removal of a memory in accordance with the resolution. Particularly, the second embodiment can easily realize cost reduction by divisionally preparing memories in correspondence with division by the display device driving method.

Third Embodiment

As another memory dividing method, upper- and lower-bit memories are arranged and added or removed in accordance with a low-cost product having a small number of gradation levels or high-end product having a large number of gradation levels.

Figure 9:
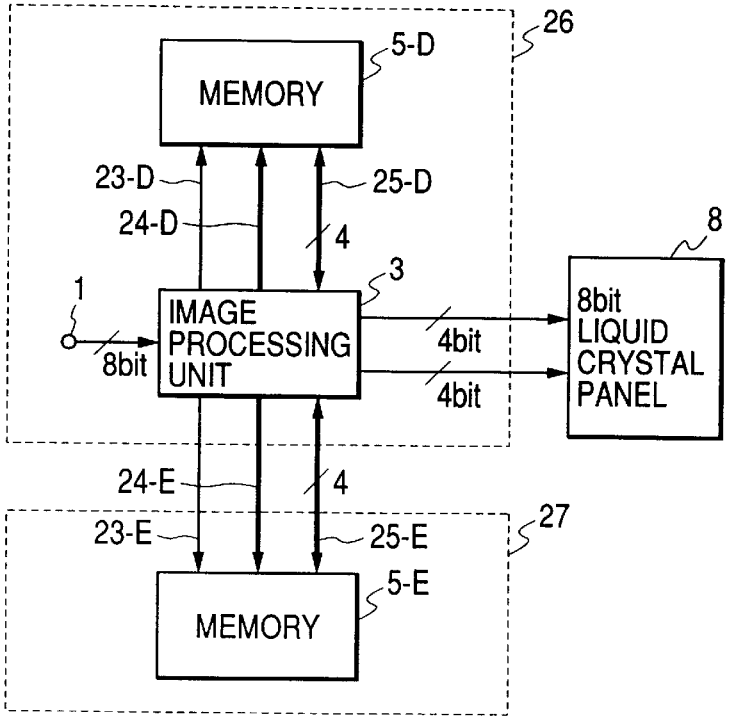
FIG. 9 is a block diagram showing an image display apparatus for explaining the third embodiment of the present invention.
Figure 10:
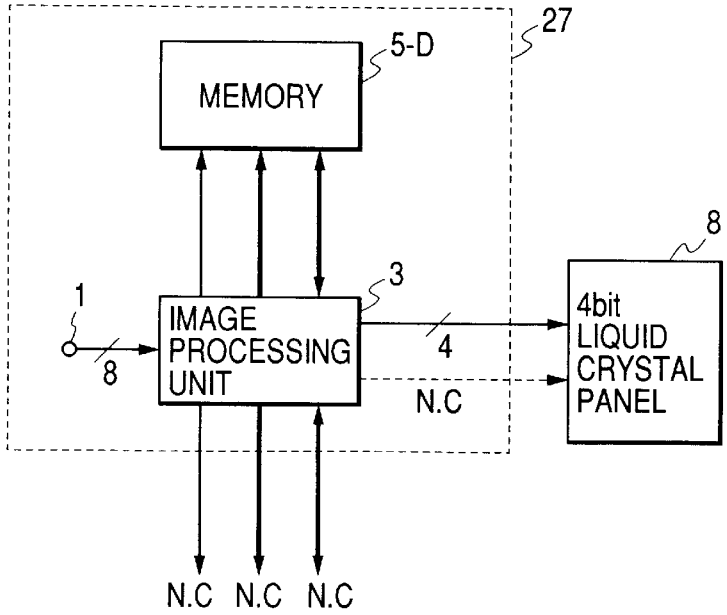
FIG. 10 is a block diagram showing the image display apparatus for explaining the third embodiment of the present invention.

FIGS. 9 and 10 are block diagrams showing the third embodiment. The image display apparatus comprises an input terminal 1 for an 8-bit digital video signal, an image processing unit 3, a frame memory 5-D for upper 4 bits of the 8-bit input, a frame memory 5-E for lower 4 bits of the 8-bit input, an 8-bit digital input liquid crystal panel 8 having a large number of gradation levels in FIG. 9 or 4-bit digital input liquid crystal panel 8 having a small number of gradation levels in FIG. 10, controls lines 23-D and 23-E for memories D and E, address lines 24-D and 24-E, and data lines 25-D and 25-E.

In a high-image-quality product having a large number of gradation levels, like the one shown in FIG. 9, a memory board 27 on which the frame memory 5-E is mounted is added to correspond to the 8-bit display element. In a low-cost product having a small number of gradation levels, like the one shown in FIG. 10, no memory board 27 is used, and a board 26 is directly used even for a product using a low-cost 4-bit display element having a small number of gradation levels, thereby sharing components and realizing cost reduction.

The control line 23 and address line 24 are set at high impedance, and the data line 25 serving as an input/output terminal is also set at high impedance in the output direction.

Fourth Embodiment

The present invention is also effective for the development of products having various display functions.

The display itself must optimize a signal to the image display device such as a liquid crystal panel by adjusting the contract, brightness, and y, but need not perform image processing using a frame memory. A system arrangement not using any frame memory is therefore the most basic product.

Figure 11:
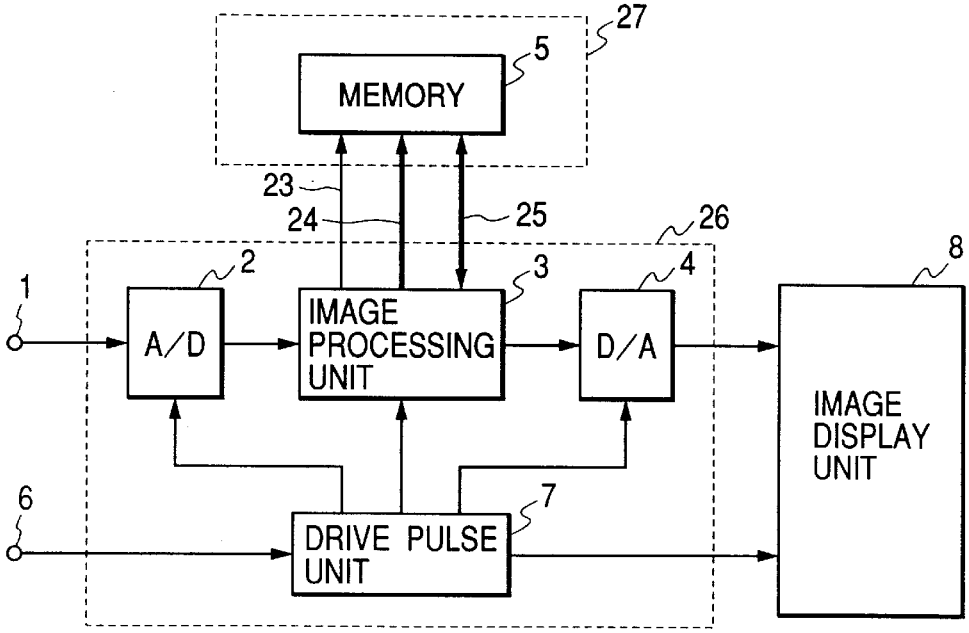
FIG. 11 is a block diagram showing an image display apparatus for explaining the fourth embodiment of the present invention.
Figure 12:
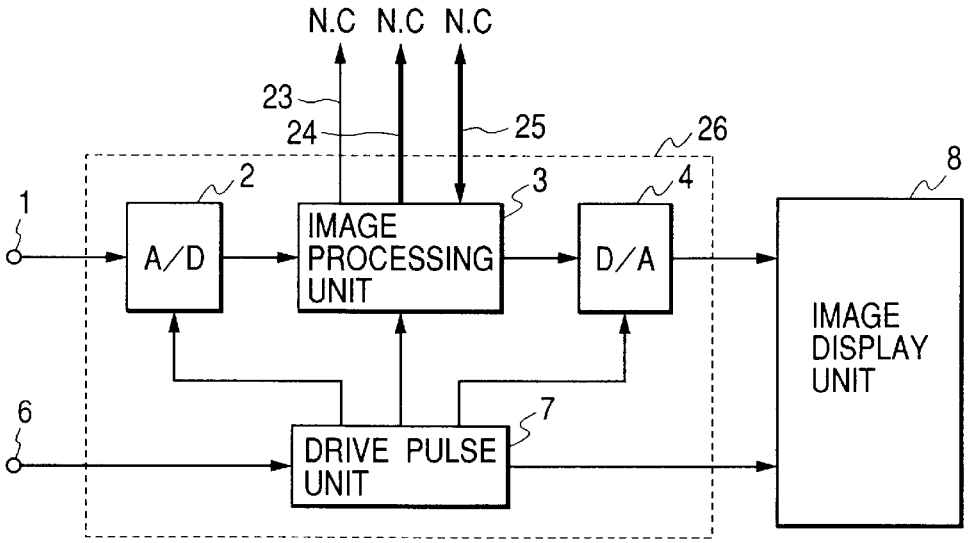
FIG. 12 is a block diagram showing the image display apparatus for explaining the fourth embodiment of the present invention.
Figure 13:
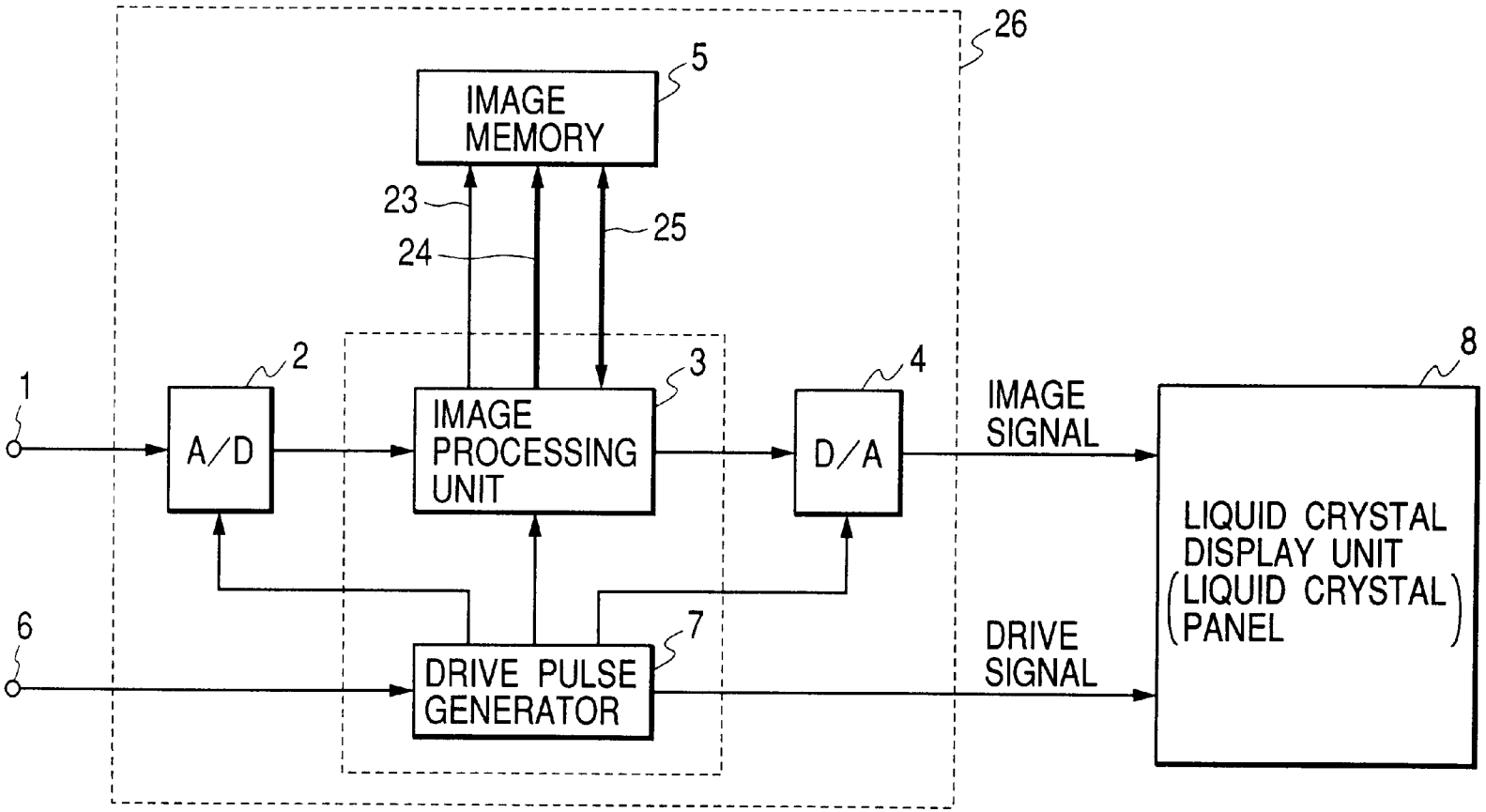
FIG. 13 is a block diagram showing an image display apparatus for explaining the prior art.

The lineup of products includes many products using a frame memory, such as a product having an image quality improving circuit for three-dimensionally processing an image to overcome device drawbacks such as a low response speed of the liquid crystal panel, and a multifunctional product having a multiwindow function and a still image function. FIGS. 11 and 12 are block diagrams showing the fourth embodiment of the present invention.

A board 26 and an image display unit 8 are common to both a single-function product and an advanced-function product, but the presence/absence of a board 27 on which a memory 5 is mounted is different between them. To realize this arrangement, the image processing unit 3 can switch a memory between a used state and an idle state. If the memory is not used, the image processing unit 3 switches the memory to remove it from the image processing path. Outputs from the memory control signal line 23 and address line 24 as idle terminals are set at high impedance, and the bidirectional input/output terminal data line 25 is also set at high impedance in the output direction.

Consequently, an advanced-function product like the one shown in FIG. 11 and a single-function product like the one shown in FIG. 12 can share components, and the cost of the product can be easily reduced.

As has been described above, according to the present invention, the region except for the data memory means can be shared by a plurality of products by dismounting or adding/removing the data memory means from or to/from the image processing means. Cost reduction can be easily realized by reducing the development cost.

Although the number of memories increases due to increases in resolution, number of gradation levels, and number of functions (multiwindows) unique to the display, basic components can be shared.

An arrangement for adding/removing a memory can be simplified by dividing memories in correspondence with divisional driving necessary for high-speed driving unique to the display.

What is claimed is:

1. An image display apparatus, comprising:

image processing means having image processing units for transferring processed input digital image data to an image display;

data memory means for storing image data for processing the digital image data; and an image display to display an image on the basis of the processed image data, wherein said data memory means can be dismounted from said image processing means, said image processing units have a plurality of control lines for controlling independently a plurality of memories mounted on said data memory means, a control signal is supplied independently to said control lines and prepared in advance for accommodating control modes according to the number of said memories mountable on said data memory means, said image processing means conducts processing for resolution and number of gradation according to the number of said memories mountable on said data memory means controlled independently by said control lines, and the image data thus processed is transferred to said image display.

2. An apparatus according to claim 1, wherein said data memory means is mounted on a board different from a board of said image processing means.

3. An apparatus according to claim 1, further comprising control means corresponding to the maximum number of data memory means assumed in advance.

4. An apparatus according to claim 1, wherein dismounting or addition/removal of said data memory means complies with divisional driving for increasing a display speed of said image display means.

5. An apparatus according to claim 1, wherein said image display means is a liquid crystal element.

6. An apparatus according to claim 1, wherein said image display means is an element for displaying an image by reflecting light.

7. An apparatus according to claim 1, wherein said image display means is an element for displaying an image by transmitting light.

8. An apparatus according to claim 1, wherein said image display means is a plasma display panel.

9. An apparatus according to claim 1, wherein said image display means is a display using a field emission device or surface conductive emission device.

10. An image display apparatus, comprising:

image processing means for transferring processed input digital image data to an image display;

data memory means for storing image data for processing the digital image data; and an image display to display an image on the basis of the processed image data, wherein a first part of said data memory means can be dismounted from said image processing means, said image processing means conducts processing according to division of driving of said image display using the first part of said data memory means which is mounted when driving of said image display is divided, and processing according to said image display, in which driving is not divided, using the remaining portion of said data memory means which is mounted on said image processing means, and the image data thus processed is transferred to said image display.

11. An apparatus according to claim 10, wherein said data memory means is mounted on a board different from a board of said image processing means.

12. An apparatus according to claim 10, further comprising control means corresponding to the maximum number of data memory means assumed in advance.

13. An apparatus according to claim 10, wherein dismounting or addition/removal of said data memory means complies with divisional driving for increasing a display speed of said image display means.

14. An apparatus according to claim 10, wherein said image display means is a liquid crystal element.

15. An apparatus according to claim 10, wherein said image display means is an element for displaying an image for reflecting light.

16. An apparatus according to claim 10, wherein said image display means is an element for displaying an image by transmitting light.

17. An apparatus according to claim 10, wherein said image display means is a plasma display panel.

18. An apparatus according to claim 10, wherein said image display means is a display using a field emission device or surface conductive emission device.

19. An image display apparatus, comprising:

image processing means for transferring processed input digital image data to an image display;

data memory means for storing image data for processing the digital image data; and an image display to display an image on the basis of the processed image data, wherein said data memory means can be dismounted from said image processing means, said image processing means conducts processing according to a multiwindow function using said data memory means which is mounted when said image display has a multiwindow function, and does not conduct processing according to a multiwindow function when said data memory means is not mounted and said image display does not have a multiwindow function, and the image data thus processed is transferred to said image display.

20. An apparatus according to claim 19, wherein said data memory means is mounted on a board different from a board of said image processing means.

21. An apparatus according to claim 19, further comprising control means corresponding to the maximum number of data memory means assumed in advance.

22. An apparatus according to claim 19, wherein dismounting or addition/removal of said data memory means complies with divisional driving for increasing a display speed of said image display means.

23. An apparatus according to claim 19, wherein said image display means is a liquid crystal element.

24. An apparatus according to claim 19, wherein said image display means is an element for displaying an image by reflecting light.

25. An apparatus according to claim 19, wherein said image display means is an element for displaying an image by transmitting light.

26. An apparatus according to claim 19, wherein said image display means is a plasma display panel.

27. An apparatus according to claim 19, wherein said image display means is a display using a field emission device or surface conductive emission device.

* * * * *